US005961085A

United States Patent [19]

Navarro et al.

[11] Patent Number: 5,961,085

[45] Date of Patent: Oct. 5, 1999

[54] LOCKING-CYLINDER SUPPORTED SURGICAL BOOT

[75] Inventors: Richard Navarro, Strongsville; Yury Keselman, Beachwood, both of Ohio

[73] Assignee: Amatech Corporation, Acton, Mass.

[21] Appl. No.: 09/052,168

[22] Filed: Mar. 31, 1998

Related U.S. Application Data

[60] Provisional application No. 60/043,377, Apr. 4, 1997.

[51] Int. Cl.[6] ..... E04G 3/00

[52] U.S. Cl. ..... 248/279.1; 5/623; 5/624; 128/878

[58] Field of Search ..... 248/287.1, 279.1, 248/118, 121, 229.1, 276.1, 278.1, 291.1, 274.1, 283.1, 284.1, 285.1, 286.1, 354.7; 5/621, 624, 658, 648, 650, 651, 623; 601/32; 602/62, 63; 269/77, 78, 67, 69; 128/878

[56] References Cited

U.S. PATENT DOCUMENTS

| | | | |
|---|---|---|---|
| 2,910,061 | 10/1959 | Rabjohn . | |
| 3,226,105 | 12/1965 | Weickgenannt et al. . | |
| 3,845,945 | 11/1974 | Lawley et al. . | |
| 4,323,060 | 4/1982 | Pecheux . | |
| 4,564,164 | 1/1986 | Allen et al. | 248/118 |
| 4,577,730 | 3/1986 | Porter . | |
| 4,632,349 | 12/1986 | Anstey | 248/281.11 |
| 4,698,837 | 10/1987 | Van Steenburg . | |
| 4,807,618 | 2/1989 | Auchinleck et al. | 128/878 |
| 4,898,491 | 2/1990 | Van Steenburg . | |
| 4,940,218 | 7/1990 | Akcelrod . | |
| 5,104,363 | 4/1992 | Shi . | |
| 5,116,008 | 5/1992 | Allen | 248/286.1 |
| 5,472,412 | 12/1995 | Knoth . | |
| 5,481,770 | 1/1996 | Ahlsten . | |
| 5,560,577 | 10/1996 | Keselman | 248/279.1 |
| 5,636,899 | 6/1997 | Schiff et al. . | |

*Primary Examiner*—Ramon O. Ramirez
*Attorney, Agent, or Firm*—Pearne, Gordon, McCoy & Granger LLP

[57] ABSTRACT

An adjustable support arm for an operating room table includes an attachment, a support rod having an end pivotally attached to the attachment and pivotable about a lithotomy axis, and a lithotomy locking cylinder operably attached to the support rod. The lithotomy locking cylinder can be unlocked to raise or lower the support rod about the lithotomy axis and locked to retain the support rod in the desired lithotomy position. The lithotomy locking cylinder is infinitely adjustable over a range and can provide an assisting lift force. The support rod can also be pivotable about an abduction axis with an abduction locking cylinder operably attached to the support rod. The abduction locking cylinder can be unlocked to laterally pivot the support rod about the abduction axis and locked to retain the support rod in the desired abduction position. The abduction locking cylinder is infinitely adjustable over a range and can provide a bias force to a minimum abduction position.

27 Claims, 9 Drawing Sheets

LOCKING-CYLINDER SUPPORTED SURGICAL BOOT

This application claims priority benefit of U.S. Provisional Application No. 60/043,377 filed on Apr. 4, 1997.

BACKGROUND OF THE INVENTION

The present invention generally relates to adjustable supports for holding in place the limb of a person during surgery and, more specifically, to such adjustable supports having a locking cylinder.

Numerous adjustable supports for holding in place the limb of a person are known in the prior art. Some adjustable limb supports incorporate various ratcheting mechanisms. These adjustable limb supports, however, have a limited number of positions which can be obtained. Other adjustable supports incorporate various ball joints. These adjustable supports, however, can expose the patient to a relatively large risk of positioning the patient in a manner which could injure the patient. Accordingly, there is a need in the art for an improved adjustable support for holding in place the limb of a person which has infinite adjustability over a range with reduced patient risk.

BRIEF SUMMARY OF THE INVENTION

The present invention provides an adjustable support arm for supporting a limb of a person during surgery which overcomes at least some of the above-noted problems of the related art. According to the present invention, the adjustable support arm includes an attachment, a support arm having an end pivotally attached to the attachment, and an extendable and retractable locking cylinder. The locking cylinder has a first end pivotally attached to the attachment and a second end pivotally attached to the support arm. The locking cylinder is unlockable to allow the support arm to pivot to a desired position and lockable to retain the support arm in the desired position. According to a preferred embodiment of the adjustable support arm, the locking cylinder is a gas-type cylinder which dampens movement of the support arm. The fluid-type locking cylinder can include an integral gas spring to provide an extension force which, for example, assists in lifting the support arm.

According to a second embodiment of the present invention, the adjustable support includes an attachment, an axle secured to the attachment and rotatable relative to the attachment about a first axis, a support arm having an end pivotally attached to the axle and pivotable about a second axis. The second axis is substantially perpendicular to the first axis. A first extendable and retractable locking cylinder has a first end pivotally attached to the attachment and a second end pivotally attached to the support arm. The first locking cylinder is unlockable to pivot the support arm about the first axis to a desired position and lockable to retain the support arm in the desired position. A second extendable and retractable locking cylinder has a first end pivotally attached to the axle and a second end pivotally attached to the support arm. The second locking cylinder is unlockable to pivot the support arm about the second axis to a desired position and lockable to retain the support arm in the desired position. According to a preferred embodiment of the adjustable support arm, each of the locking cylinders are a gas-type cylinder which dampens movement of the support arm. The fluid-type locking cylinders can include an integral gas spring to provide an extension force.

BRIEF DESCRIPTION OF THE SEVERAL VIEWS OF THE DRAWINGS

These and further features of the present invention will be apparent with reference to the following description and drawings, wherein.

DETAILED DESCRIPTION OF THE INVENTION

Figure 1:
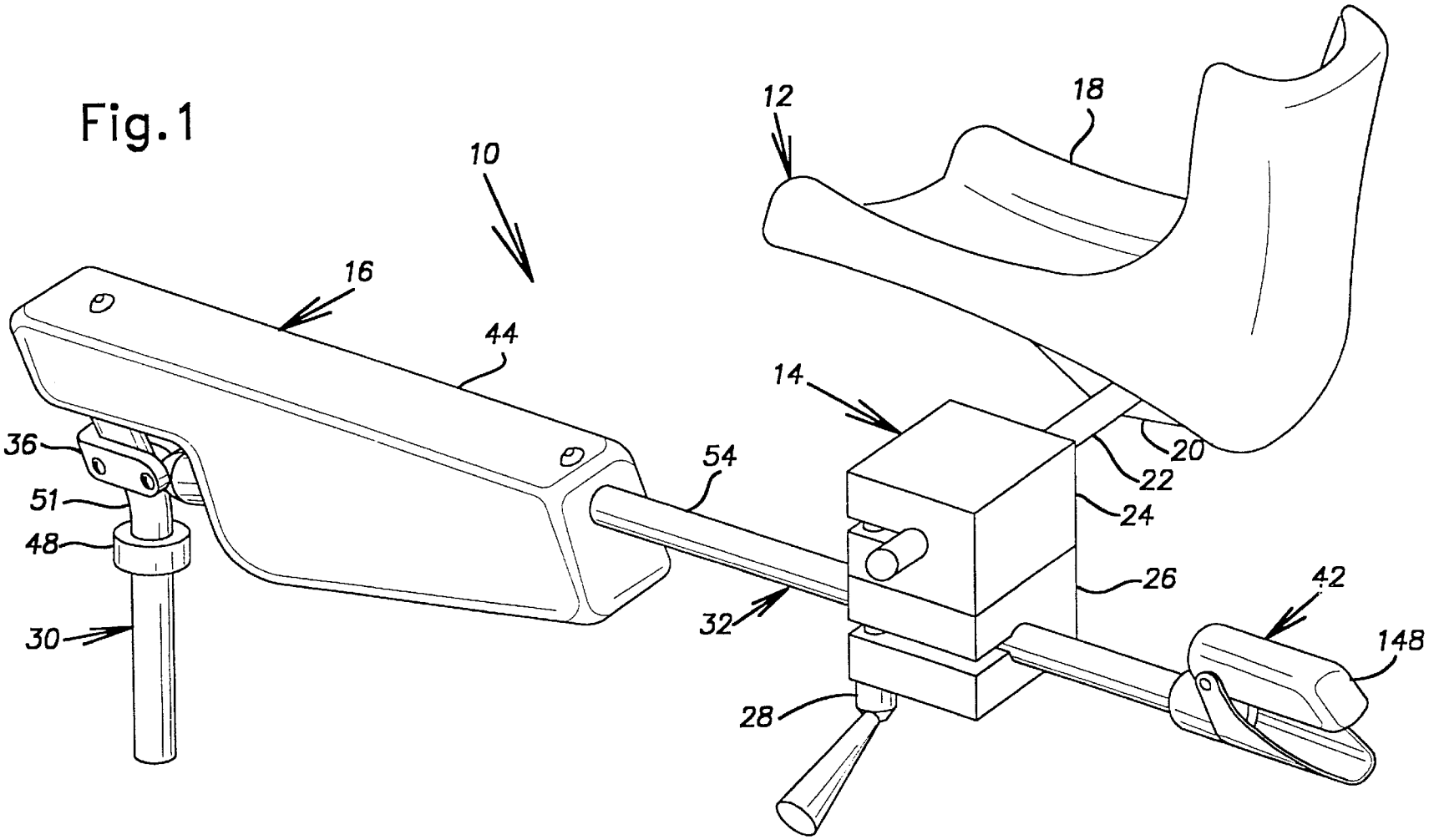
FIG. 1 is a perspective view of a surgical boot assembly according to the present invention.

FIG. 1 illustrates a surgical boot assembly or stirrup 10 according to the present invention which includes a limb support 12, an adjustable clamping assembly 14, and an adjustable support arm 16 which has adjustable lithotomy.

The limb support 12 of the illustrated embodiment includes a surgical boot 18 and a mounting bracket 20. The boot 18 is sized and shaped for receiving and supporting a foot and lower leg of a patient. The boot 18 is typically molded from a plastic material. A suitable boot 18 is shown in detail in U.S. Pat. No. Des. 385,040 which is expressly incorporated herein in its entirety by reference. The mounting bracket 20 is secured to the bottom of the boot 18 and has a support rod 22 laterally extending therefrom.

The adjustable clamping assembly 14 adjustably secures the limb support 12 to the adjustable support arm 16. The adjustable clamping assembly 14 includes first and second blocks 24, 26 each having a passage for the support rod 22 of the limb support 12 and the adjustable support arm 16 respectively. Each block 24, 26 also has a slot extending from the passage to a side of the block 24, 26 and a hole extending perpendicular to and through the slots. A compression head 28 has a threaded member which passes through the hole in the second block 26 and into threads in the first block 24 beyond the slot. When a handle of the compression head 28 is turned to advance the threaded member, the slots tend to close somewhat to prevent movement of the rods within the passages and relative movement between the blocks 24, 26. When the handle of the compression head 28 is turned to withdraw the threaded member, the rods within the passages can be moved to desired positions relative to the blocks 24, 26 and the blocks 24, 26 can be rotated relative to each other. Suitable adjustable clamping assemblies 14 are described in detail in U.S. Pat. Nos. 4,564,164 and 5,116,008 which are expressly incorporated herein in their entirety by reference. It is noted that other types of connections can be utilized to attach the limb support 12 to the adjustable support arm 16 within the scope of the present invention.

Figure 2:
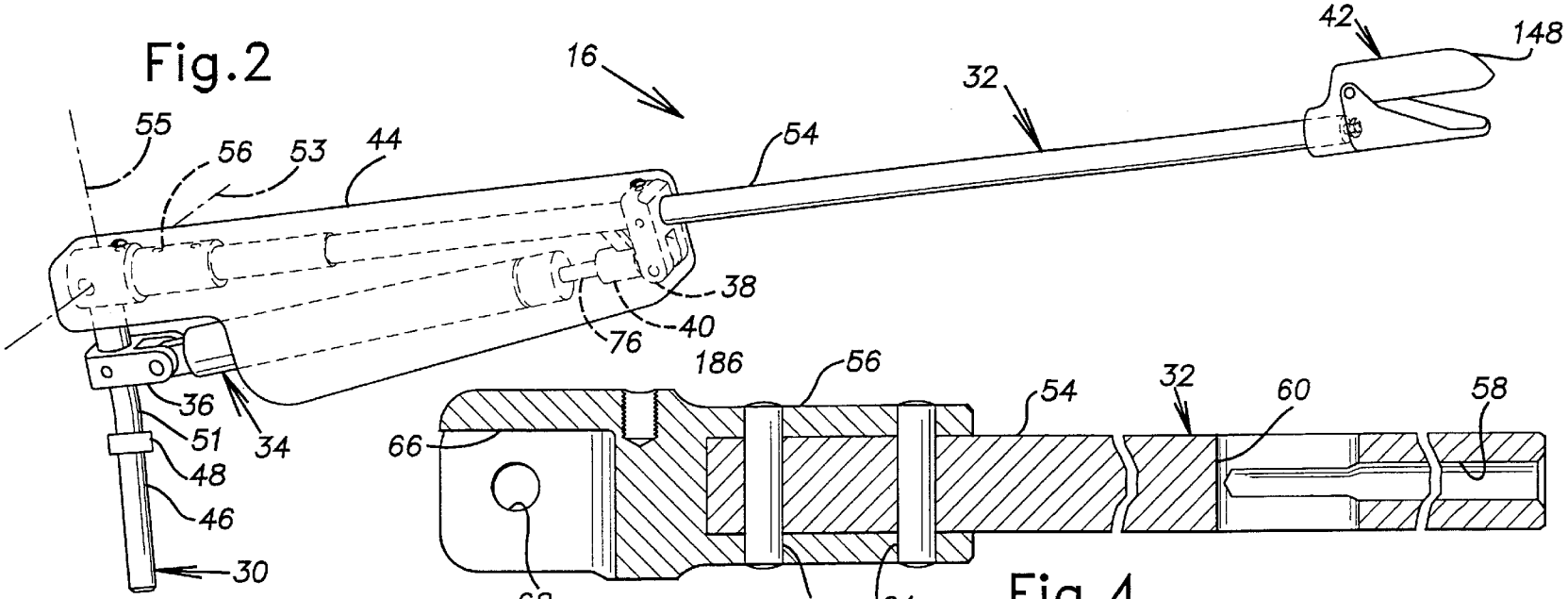
FIG. 2 is a perspective view of an adjustable support arm of the surgical boot assembly of FIG. 1.
Figure 3:
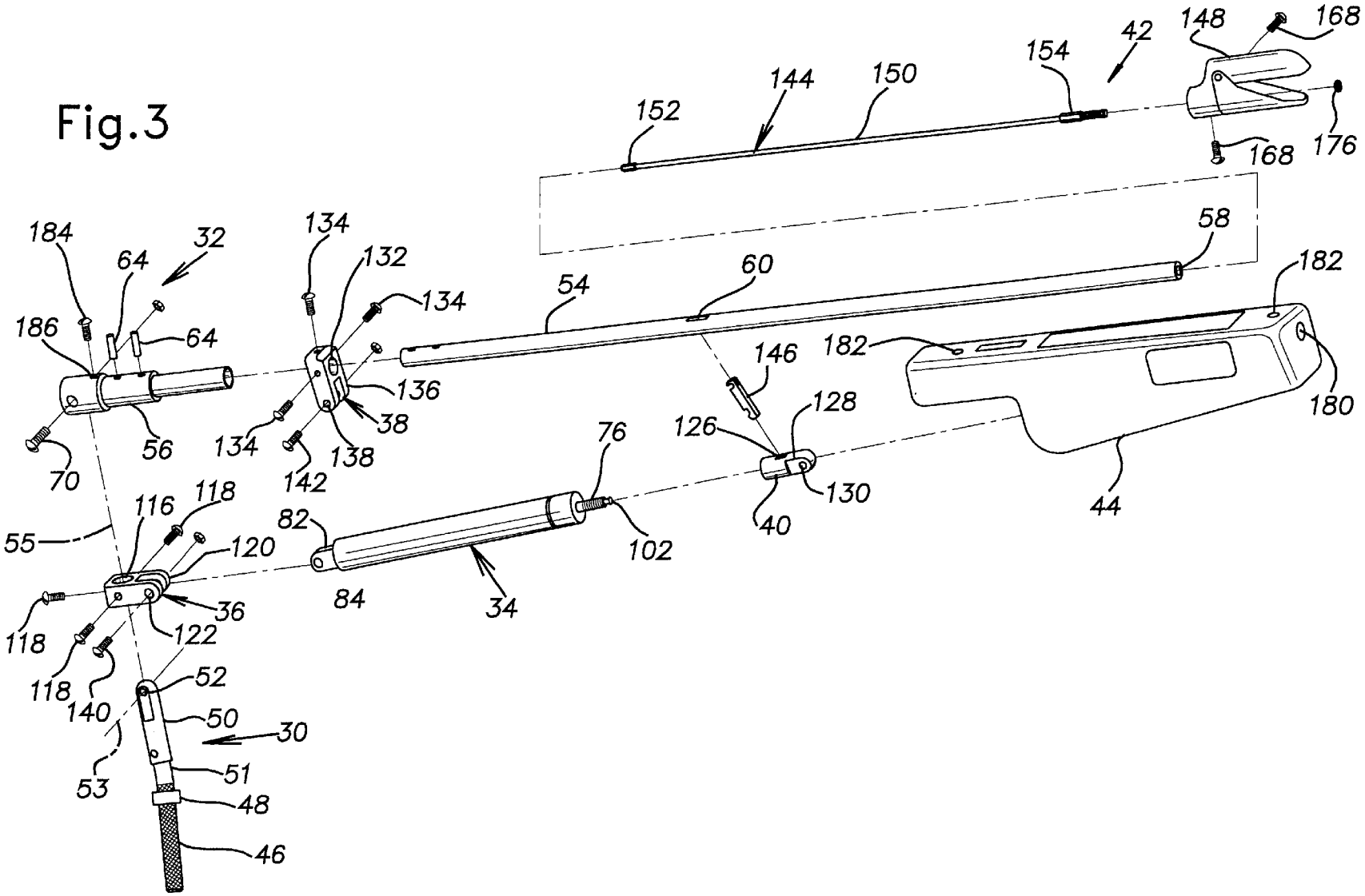
FIG. 3 is an exploded perspective view of the adjustable support arm of FIG. 2.

As best shown in FIGS. 2 and 3, the adjustable support arm 16 includes an attachment 30, a rod or arm assembly 32, a lithotomy locking cylinder 34, a post pivot element 36, a rod pivot element 38, an actuator head 40, a remote actuator assembly 42, and a protective cover 44. The attachment 30 is adapted to secure the adjustable support arm 16 to the side of an operating room table or bed (not shown). The attachment 30 of the illustrated embodiment includes a post 46 which is removably received and rotationally held in socket clamp (not shown) which is typically a fitting located at the side of the operating room table. The post 46 preferably has a lower end which is knurled to improve interaction with the socket clamp.

The attachment 30 preferably includes a ring-shaped stop collar 48 secured to the post 46 at a predetermined distance from the lower end of the post 46. The stop collar 48 is sized so that it can not be inserted into the socket clamp in order to ensure that the post 46 is inserted into the socket clamp a proper distance. The upper end of the post 46 forms a trunnion 50 having a laterally extending opening 52 therethrough which defines a lithotomy axis 53. The lithotomy axis 53 is "generally" horizontal, that is, within about 30 degrees of horizontal. Preferably, the lithotomy axis 53 is at an angle of about 20 degrees relative to horizontal as discussed in more detail hereinafter.

The post 46 preferably has a bend 51 between the stop collar 48 and the trunnion 50 so that an abduction axis 55, substantially perpendicular to the lithotomy axis 53, which is defined by the upper end of the post 46 is at an angle relative to vertical when the post 46 is in the vertically extending socket clamp. The bend 51 is preferably sized so that the abduction axis 55 is at an angle in the range of about 10 to about 30 degrees relative to vertical, and more preferably forms an angle of about 20 degrees relative to vertical. It is noted, however, that the post 46 could be bent to other angles.

The post 46 is bent laterally so that the adjustable support arm 16 angles upwardly and outwardly from the side of the operating room table (best shown in FIG. 1), that is, the adjustable support assembly is raised and lowered about the lithotomy axis 53 in a plane which is at an angle, preferably 20 degrees, from vertical as will be described in more detail hereafter. It is this angled abduction axis 55 or plane of movement which provides an "automatic abduction" characteristic as the arm assembly 32 is rotated about the lithotomy axis 53. It is noted that other types of attachments 30 such as, for example, clamps can be utilized to connect the adjustable support arm 16 to the operating room table.

Figure 4:
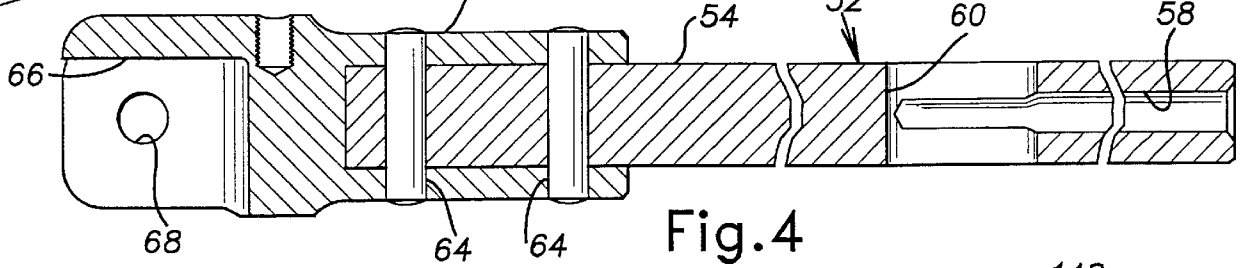
FIG. 4 is a side elevational view, in cross-section, of a rod assembly of the adjustable support arm of FIG. 3.

As best shown in FIGS. 3 and 4, the rod assembly 32 includes a support rod 54 and an adapter 56. The support rod 54 is generally elongate and circular in cross-section. A central passage 58 extends through a portion of the support rod 54 from a first end of the support rod 58 to a slot 60 at a central portion of the support rod 58. The slot 60 vertically extends through the support rod 54 for a limited longitudinal length of the support rod 54.

The adapter 56 has a first end which forms a socket 62 sized for receiving the second end of the support rod 54. The adapter 56 is rigidly secured to the support rod 54 to prevent relative longitudinal or rotational movement therebetween. In the illustrated embodiment, a pair of pins 64 are press fit through the socket 62 of the adapter 56 and the support rod 54. The adapter 56 has a second end adapted to pivotally receive the trunnion 50 of the attachment post 46. The second end of the adapter 56 has a cavity 66 formed therein sized for receiving the trunnion 50 of the attachment post 46 and allowing relative rotation therebetween. The second end of the adapter 56 also has a laterally extending opening 68 which passes through the cavity 66 and is sized and located to cooperated with the opening 52 of the trunnion 50.

A pivot member 70 extends through the openings 52, 68 in the trunnion 50 and the adaptor 56 to pivotally connect the rod assembly 32 to the attachment post 46. In the illustrated embodiment, the pivot member 70 is a shoulder screw and nut. It is noted however, that other types of axle members could be utilized such as, for example, a press-fit pin or a rivet.

As best shown in FIGS. 2 and 3, the lithotomy locking cylinder 34 extends between the attachment 30 and the arm assembly 32 to control rotation of the arm assembly 32 about the lithotomy axis 53 as described in more detail hereinafter. The term "locking cylinder", within the specification and claims, means an element having a body or cylinder and a rod or tube which can be extended into and retracted out of the cylinder to vary the length of the element and can be selectively locked into positions to obtain desired lengths. Preferably, the locking cylinder can be locked at an infinite number of positions between two limits, that is, over a range. Therefore, the locking cylinder can be, for example, a fluid-type locking cylinder (FIGS. 5, 6*a*, 6*b*) or a mechanical-type locking cylinder (FIG. 6*c*) as described in more detail hereinafter. Suitable fluid-type locking cylinders are available from Stabilus Inc. of Colmar, Pa., under the mark BLOC-O-LIFT and also from HAHN-Gasfedern GmbH of Germany and marketed in the U.S. by Hahn Gas Springs of Melbourne Fla. Suitable mechanical-type locking cylinders are available from the P.L. Porter Company of Woodland Hills, Calif., under the mark MECHLOK. Additionally, the locking cylinder can provide an extension bias or lifting force (FIGS. 5, 6*b*, 6*c*) or no extension bias or lifting force (FIG. 6*b*) as described in more detail hereinafter. The extension bias is preferably sized for lifting a relatively large patient. A suitable extension bias is believed to be about 500 newtons.

Preferably, the locking cylinder 34 is a fluid-type locking cylinder, is infinitely positionable over a range to a desired position, is rigidly blockable or lockable in a desired position by means of a fluid-valve lock, provides an extension or lifting force by means of a gas spring, and dampens movement in both retraction and extension directions.

Figure 5:
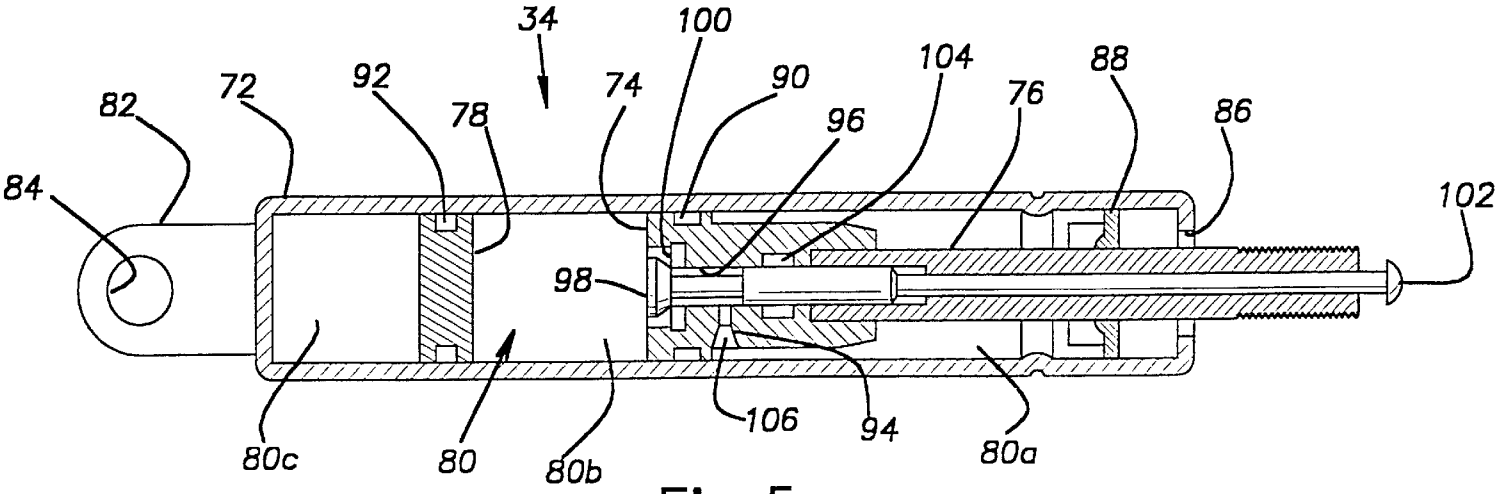
FIG. 5 is a side elevational view, in cross-section, of a locking cylinder of the adjustable support arm of FIG. 3.

FIG. 5 illustrates a fluid-type locking cylinder 34 having an extension bias provided by an integral gas spring. The locking cylinder 34 includes a hollow body or cylinder 72, a piston 74, a piston rod 76, and a separating piston 78. The tubularly-shaped cylinder 72 forms a hollow interior space 80. A first or rear end of the cylinder 72 is closed or sealed and is provided with a trunnion 82 having a laterally extending opening 84. The trunnion 80 is sized and shaped to cooperate with the post pivot element 36. A second or forward end of the cylinder 72 forms an opening 86 for the piston rod 76 and is provided with a seal and guide system 88 to seal the opening 86 and to support the piston rod 76 for axial movement relative to the cylinder 76.

The piston 74 is located within the cylinder 72 and divides the sealed interior 80 space into first and second portions 80*a*, 80*b*. A ring-shaped sealing member 90 is provided about the periphery of the piston 74 to form a seal between the piston 74 and the interior surface of the cylinder 72. The first and second portions 80*a*, 80*b* of the interior space 80 are filled with a incompressible fluid such as, for example, oil.

The piston rod 76 extends through the opening 86 in the forward end of the cylinder 72 and is secured to the piston 74 for movement therewith. The forward end of the piston rod 76 is provided with a threaded portion which is sized to cooperate with the actuator head 40. The piston rod 76 is sealed and supported by the seal and guide system 88 of the cylinder 72.

The separating piston 78 is located within the cylinder 72 between the piston 74 and the rear end of the cylinder 72. The separating piston 78 forms a third portion 80*c* of the sealed interior space 80 located behind the first and second portions 80*a*, 80*b*. A ring-shaped sealing member 92 is provided about the periphery of the separating piston 78 to form a seal between the separating piston 78 and the interior surface of the cylinder 72. The third portion 80*c* of the interior space 80 is filled with a compressed gas such as, for example, compressed nitrogen. Preferably, a small quantity of oil is also provided in the third portion 80*c* of the interior space 80 to ensure proper lubrication.

The piston 74 is provided with an integral valve assembly 94 which includes a passage 96, a valve 98, a valve seat 100, and a release plunger 102. The passage 96 of the illustrated embodiment has a first section which extends axially into the piston 74 from the second portion 80*b* of the interior space 80 and a second portion which radially extends from the first section of the passage 96 to the first portion 80*a* of the interior space 80. The valve 98 and valve 100 seat are provided at the rear end of the piston 74 and cooperate to selectively close and open the passage 96. The valve 98 is biased into the closed position, preferably by a spring member. The release plunger 102 is fixed to the forward side of the valve 98 and axially extends through the piston 74 and the piston rod 76. The release plunger 102 is provided with a suitable sealing member 104 to seal the passage. When the release plunger 102 is operated with enough force to overcome the closing bias on the valve 98, the valve 98 is axially displaced from the seat 100 and the passage 96 provides fluid flow communication between the first and second portions 80*a*, 80*b* of the interior space 80.

The valve assembly 94 is opening by applying an axial force onto the forward end of the release plunger 102 which over comes the closing bias and moves the valve 98 rearwardly away from the seat 100. When the valve assembly 94 is open, the locking cylinder 34 is infinitely positionable and therefore can be moved, that is the rod 76 can be extended or retracted, to any desired position. The valve assembly 94 is closed by removing the axial force from the release plunger 102 so that the closing bias returns the valve 98 to the valve seat 100 to sealingly close the passage 96. When the valve assembly 94 is closed, the locking cylinder 34 is blocked or locked at that position. A rigid blocking effect is obtained because the piston 74 is moved over its range of stroke within the incompressible fluid. The rigid blocking effect can be in either the extension or compression direction depending on the design. The pressure of the compressed gas acts to provide the locking cylinder 34 with an extension force. When the extension force is higher than forces applied to the forward end of the piston rod 76 and the valve assembly 94 is open, the locking cylinder 34 extends until the valve assembly 94 is closed or the locking cylinder reaches a fully extended position. The extension rate and damping are determined by the characteristics of a nozzle 106 located in the second section of the passage 96.

Figure 6A:
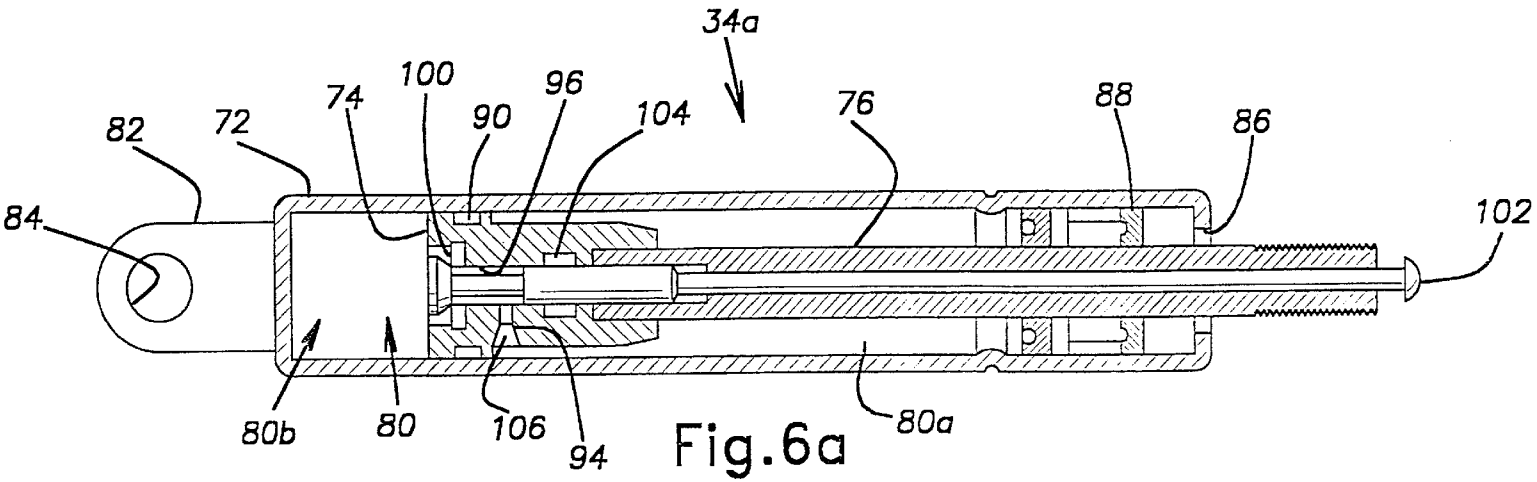
FIG. 6*a* is a side elevational view, in cross-section, of an alternative embodiment of the locking cylinder of FIG. 5.

FIG. 6*a* illustrates an alternative fluid-type locking cylinder 34*a* having no extension bias. Like reference numbers are used to identify like structure. The locking cylinder 34*a* illustrates that no extension bias is required with a fluid-type locking cylinder and also that a resilient locking effect can be obtained by a fluid-type locking cylinder. The locking cylinder 34*a* is substantially the same as to the locking cylinder 34 of FIG. 5 except that it does not have a separating piston 78 (FIG. 5). The separating piston 78 is not necessary because compressed gas is utilized through the valve assembly 94 rather than incompressible fluid. Both the first and second portions 80*a*, 80*b* of the cylinder interior space 80 are filled with the compressed gas. A resilient blocking effect is obtained because the piston 74 is moved over its range of stroke within the gas which is compressible. The resilient blocking effect is in both the extension and compression directions.

Figure 6B:
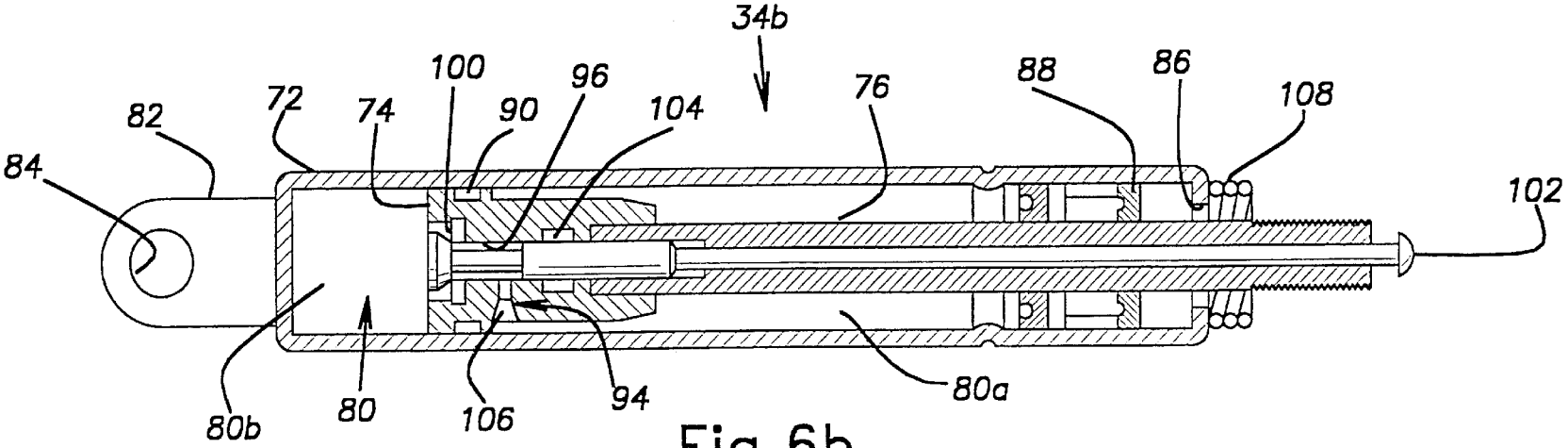
FIG. 6*b* is a side elevational view, in cross-section, of another alternative embodiment of the locking cylinder of FIG. 5.

FIG. 6*b* illustrates another alternative fluid-type locking cylinder 34*b* having an extension bias provided by an external mechanical spring 108. Like reference numbers are used to identify like structure. The locking cylinder 34*b* illustrates that a mechanical and/or external spring can be utilized rather than an internal and/or gas spring to obtain the extension force. The locking cylinder 34*b* also illustrates that resilient blocking can be obtained in combination with an extension force. The locking cylinder 34*b* is substantially the same as to the locking cylinder 34 of FIG. 5 except that it does not have a separating piston 78 because the compressed gas is not utilized to supply the extension force. The locking cylinder 34*b* is also substantially the same as the locking cylinder 34*a* of FIG. 6*a* except that it has an external mechanical spring 108 to supply an extension force.

The mechanical spring 108 of the illustrated embodiment is a coil compression spring which extends over the piston rod 76 between the forward end of the cylinder 72 and the actuator head 40 when the actuator head 40 is attached to the forward end of the piston rod 76. The mechanical spring 108 acts to provide the locking cylinder 34*b* with an extension force. When the extension force provided by the mechanical spring 108 is higher than forces applied to the forward end of the piston rod 76 and the valve assembly 94 is open, the piston rod 76 extends until the valve assembly 94 is closed or the locking cylinder 34*b* reaches a fully extended position.

Figure 6C:
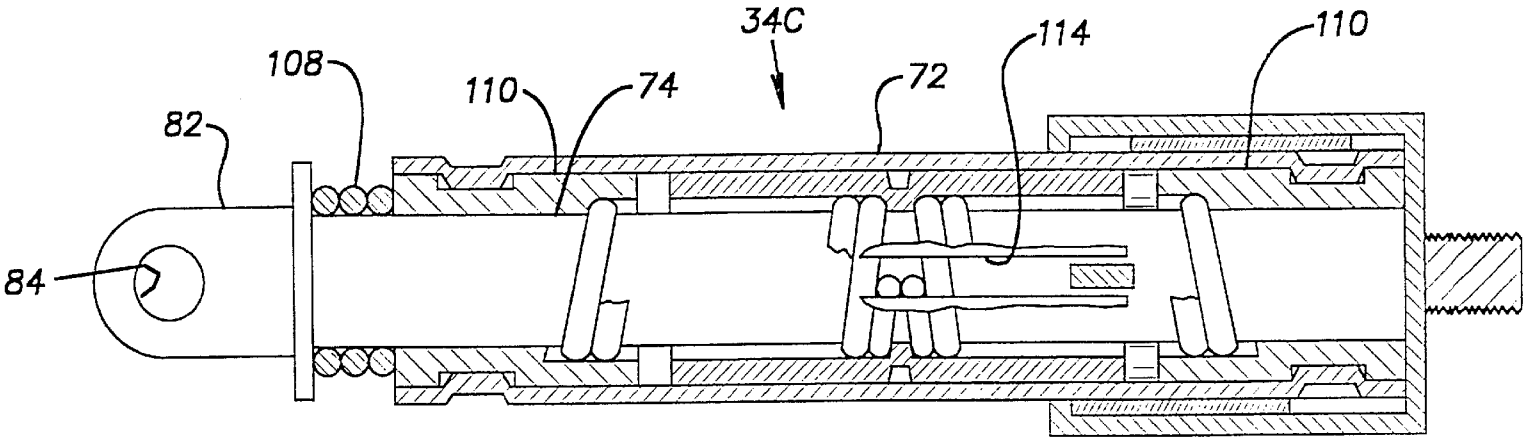
FIG. 6*c* is a side elevational view, in cross-section, of yet another alternative embodiment of the locking cylinder of FIG. 5.

FIG. 6*c* illustrates yet another alternative locking cylinder 34*c* which is of the mechanical-type. Like reference numbers are used to identify like structure. The locking cylinder 34*c* illustrates that a mechanical-type lock rather than a fluid-type lock can be utilized to lock the position of the adjustable support arm 16.

The rod 74 is supported within the cylinder 72 by a pair of bearing or support members 110. A pair of coil torsion springs 112 are wound about the rod 74. The springs 112 each have a normal inner diameter smaller than the rod 74 such that the springs 112 grip the rod 76 against translational movement within the cylinder 72. A release assembly 114 is actuatable for partly unwinding the springs 112 to thereby release the rod 76 for movement relative to the cylinder 72. See U.S. Pat. No. 4,577,730, the disclosure of which is expressly incorporated herein in its entirety by reference, for a more detailed description of a suitable locking cylinder 34*c* having a mechanical lock.

The locking cylinder 34*c* also illustrates that the cylinder 72 and the rod 76 can be used in a reverse orientation. In this configuration, the cylinder 72 has a threaded portion to cooperate with the actuator head 40, or alternately still has the trunnion 82, and the rod 76 is provided with a trunnion 80 to cooperate with the post pivot element 36. This reversed orientation is particularly desirable when the actuator or release assembly 114 is carried by the cylinder 72 rather than the rod 76 so that a generally fixed distance is maintained between the release assembly 114 and the remote actuator assembly 42.

It is noted that the mechanical spring 108 can be eliminated if the extension force is not desired. It is also noted than a separate damping element can be used in parallel with the locking cylinder 34*c* if a dampening effect is desired.

As best shown in FIG. 3, the post pivot element 36 has an opening 116 sized for receiving the attachment post 46 therein. The post pivot element 36 is secured to the attachment post 46 between the bend 51 and the trunnion 50. The post pivot element 36 of the illustrated embodiment is secured to the attachment post 46 with three set screws 118. The post pivot element 36 also has a clevis 120 with a laterally extending opening 122. The clevis 120 is sized to cooperate with the trunnion 82 of the locking cylinder 34.

Figure 7:
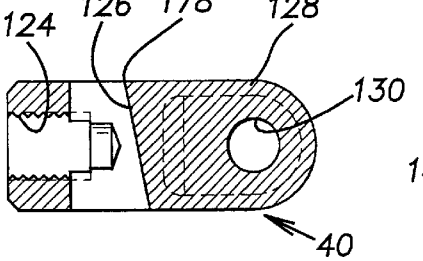
FIG. 7 is a side elevational view, in cross-section, of an actuator head of the adjustable support arm of FIG. 3.

As best shown in FIGS. 3 and 7, the actuator head 40 has a threaded opening 124 sized for cooperating with the piston rod 76 of the locking cylinder 34 to secure the actuator head 40 to the end of the piston rod 76. The threaded opening 124 extends from a rear end of the actuator head 40 to a slot 126. The slot 126 vertically extends through the actuator head 40. The actuator head 40 also has a trunnion 128 with a laterally extending opening 130. The trunnion 128 is sized to cooperate with the rod pivot element 38.

The rod pivot element 38 has an opening 132 sized for receiving the support rod 54 therein. The rod pivot element 38 is secured to the central portion of the support rod 54 in a position slightly forward of the slot 60. The rod pivot element 38 of the illustrated embodiment is secured to the attachment post 46 with three set screws 134. The rod pivot element 38 also has a clevis 136 with a laterally extending opening 138. The clevis 136 is sized to cooperate with the trunnion 128 of the actuator head 40.

A pivot member 140 extends through the openings 84, 122 in the cylinder trunnion 82 and the pivot element clevis 120 to pivotally connect the locking cylinder 34 to the attachment post 46. In the illustrated embodiment, the pivot member 140 is a shoulder screw and nut. It is noted however, that other types of pivot members could be utilized such as, for example, a press-fit pin or rivet.

A pivot member 142 extends through the openings 130, 138 in the actuator head trunnion 132 and the pivot element clevis 136 to pivotally connect the locking cylinder 34 to the support rod 54. In the illustrated embodiment, the pivot member 142 is a shoulder screw and nut. It is noted however, that other types of pivot members could be utilized such as, for example, a press-fit pin or rivet.

Secured in this manner, the locking cylinder 34 supports the arm assembly 32 in compression when downward loads are applied to the outer end of the arm assembly 32. It is noted, however, that the locking cylinder 34 could be configured and secured in manner to support the arm assembly 32 in tension. With the locking cylinder 34 pivotally connected at each end between the attachment 30 and the arm assembly 32, the support arm 16 can be infinitely raised and lowered over a range about the pivot member 70 connecting the attachment 30 and the arm assembly 82 at the rear end of the arm assembly 32 when the locking cylinder 34 is unlocked. The range is preferably about −22 degrees to about +90 degrees relative to horizontal.

Figure 10:
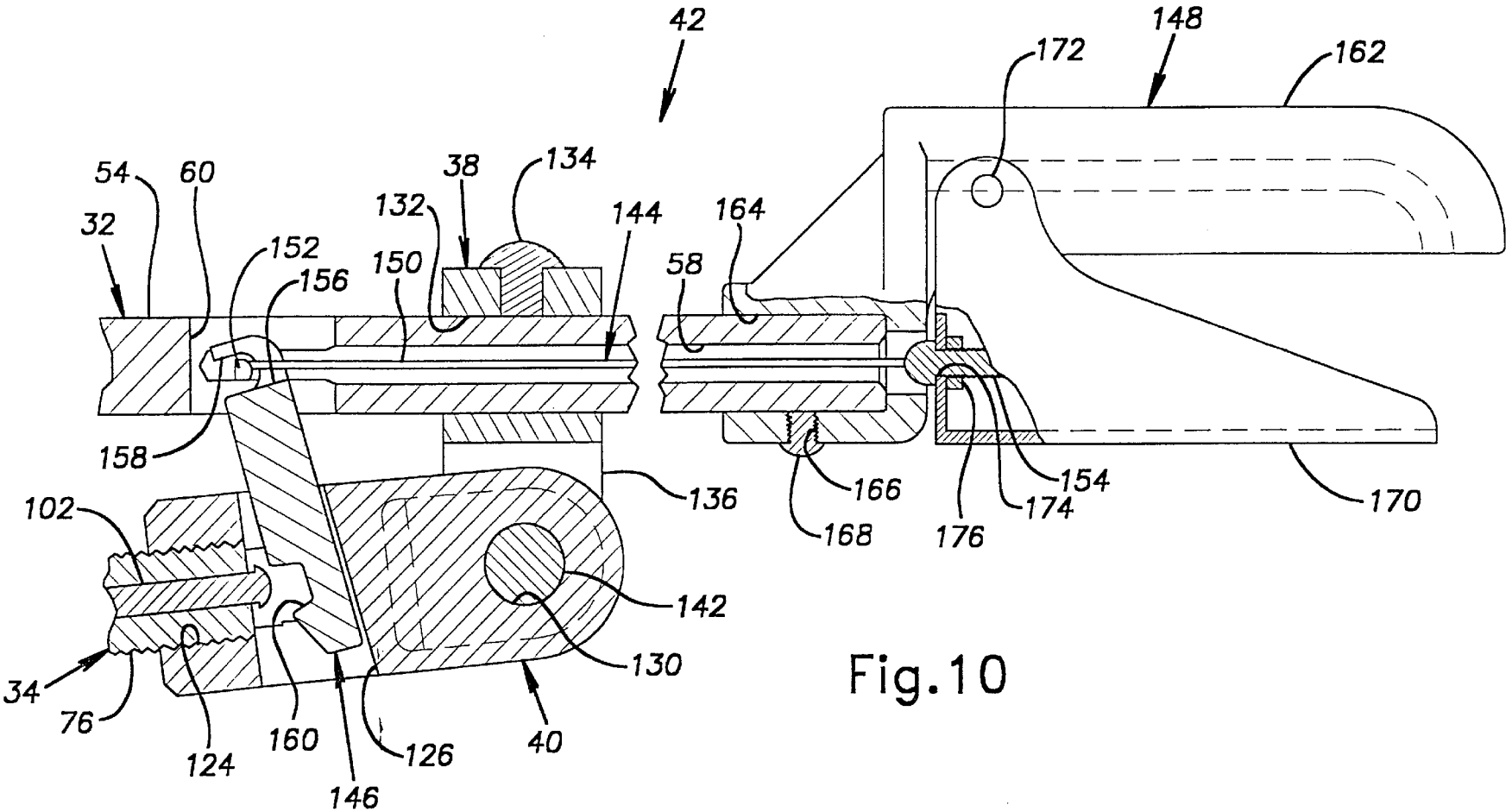
FIG. 10 is an enlarged, fragmented elevational view, partially in cross-section, of a remote actuator assembly of the adjustable support arm of FIG. 2 with a protective cover removed for clarity.

As best shown in FIGS. 2, 3 and 10, the remote actuator assembly 42 includes a cable assembly 144, an actuator lever 146, and a handle assembly 148. The actuator assembly 42 unlocks the locking cylinder 32 so that the support arm can be pivoted to a desired position. Preferably, the actuator assembly 42 allows the locking cylinder 34 to be unlocked at a location remote from the locking cylinder 34. In the illustrated embodiment, the locking cylinder 34 is unlocked by squeezing the handle assembly 146 at the forward end of the rod assembly 32.

As best shown in FIGS. 3 and 10, the cable assembly 144 includes a length of cable 150, a radius plug 152, and a threaded terminal 154. The cable 150 is preferably a wire rope but other suitable cables or flexible rods can be utilized. It is noted that it may be necessary for the cable 150 to include a push-pull type cable having an outer sheath or conduit and a flexible inner cable or core which is pushed and pulled through the conduit, particularly when the there is not a fixed distance between the release of the locking cylinder and the handle assembly 148. The radius plug 152 is secured to the rear end of the cable 150 and is sized to cooperate with the actuator lever 146. The threaded terminal 154 is secured to the forward end of the cable 150 and is sized to cooperate with the handle assembly 148.

Figure 8:
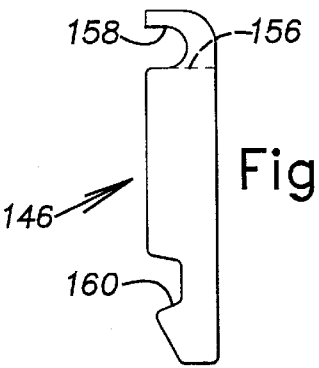
FIG. 8 is a side elevational view of an actuator lever of the adjustable support arm of FIG. 3.

As best shown in FIGS. 3, 8, and 10, the actuator lever 146 has a forked end which forms a channel 156 for the cable 150 to pass therethrough and a recess 158 for the radius plug 152. The actuator lever 146 also has a notch or groove 160 sized to cooperate with the release plunger 102 of the locking cylinder 34.

Figure 9:
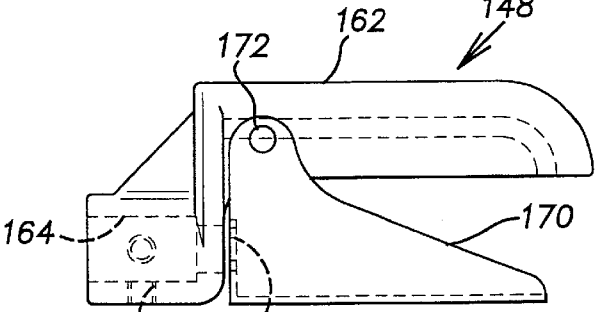
FIG. 9 is a side elevational view of a handle assembly of the adjustable support arm of FIG. 3.

As best shown in FIGS. 3, 9 and 10, the handle assembly 148 includes a handle grip 162 having a socket 164 sized for receiving the forward end of the support rod 54 therein. Two threaded holes 166 extend into the socket 164 perpendicular to one another. The threaded holes 166 receive set screws 168 which secure the handle grip 162 to the end of the support rod 54. The handle assembly 148 also includes a handle lever 170 which is pivotally attached to the handle grip 162 with a pivot element 172. The handle lever 170 is pivotable between a first or unactuated position (shown in FIGS. 9 and 10) and a second or actuated position (not shown) when the handle lever 170 and the handle grip 162 are squeezed together. Preferably, the handle lever is biased to the unactuated position. The pivot element 172 is preferably a rivet but any other type of suitable pivot element could be utilized such as, for example, a pressed pin or shoulder screw. The handle lever 170 has an opening 174 generally coaxial with the socket 164 of the handle grip 162 when the handle lever 170 is in the unactuated position. The opening 174 is sized to cooperate with the threaded terminal 154 of the cable assembly 144. The threaded terminal 154 is preferably secured to the lever 170 with a nut 176.

The upper end of the actuator lever 146 is located in the slot 60 of the support arm 54 with the cable 150 passing through the channel 156 and the radius plug 152 securely held within the recess 158. The lower end of the actuator lever 146 extends into the slot 126 of the actuator head 40 forward of the release plunger 102 of the locking cylinder 34. It is noted that with the mechanical-type locking cylinder 34*c* (FIG. 6*c*), the actuator lever 146 can be eliminated with the cable 150 extending to the release assembly 114.

With the handle lever 170 of the handle assembly 148 in the unactuated position, the actuator lever 146 is positioned so that it is not applying a force on the end of the release plunger 102 of the locking cylinder 34. When the handle grip 162 and handle lever 170 are squeezed together, however, the handle lever 170 pivots and forwardly pulls the cable assembly 144. The cable assembly 144 forwardly pulls the upper end of the actuator lever 146 and pivots the actuator lever 146 about an upper edge 178 of the slot 126 in the actuator head 40. The pivoting of the actuator lever 146 causes the notch 160 of the actuating lever 146 to engage and depress the release plunger 102 of the locking cylinder 34 to open the valve assembly 94 of the locking cylinder 34. Note that the slot 126 of the actuator head 40 is sized and shaped for the pivoting movement of the actuator lever 146. When the handle assembly 148 is released, the handle bias returns the handle lever 170 to the unactuated position and the locking cylinder bias returns the release plunger 102 and the actuating lever 146 to their unactuated positions. It is noted that other types of remote actuator assemblies 42 can be utilized such as, for example, a rotating handle with a cam such as disclosed in U.S. Pat. No. 5,560,577 which is expressly incorporated herein in its entirety by reference. The "squeezing-action" of the present invention, however, is preferable over other types of manipulations such as, for example, twisting or turning.

As best shown in FIGS. 2 and 3, the protective cover 44 generally encloses at least the lower portion of the rod assembly 32, the majority of the locking cylinder 34, the rod pivot element 38, the actuator head 40, and the actuator lever 146. The protective cover 44 is preferably rigid and is preferably molded of a plastic material. The protective cover 44 is sized and shaped to allow pivotal movement between the attachment 30 and the rod assembly 32. The protective cover 44 has an opening 180 at a forward end which is sized for passage of the support rod 54 therethrough and has a generally open rear end sized for pivotal movement of the locking cylinder 34. The top of the protective cover 44 has a pair of openings 182 for attachment fasteners. The forward one of the openings 182 cooperates with one of the set screws 134 securing the rod pivot element 38 and the rear one of the openings 182 cooperates with an attachment screw 184 to secure the protective cover to the rod assembly 32 and the rod pivot element 38. The adapter 56 of the rod assembly 32 is provided with a threaded hole 186 for the attachment screw 184.

The surgical boot assembly 10 is removably secured to the side of an operating room table by clamping the attachment post 46 into a socket clamp. Due to the bend 51 in the attachment post 46, the adjustable support arm 16 extends angularly outward from the side of the table. Typically, a second surgical boot assembly is removably secured to the opposite side of the table in the same manner. The second surgical boot assembly, however, has an attachment post bent in the opposite direction. In this configuration a patient lies with their back on the table and a foot in each surgical boot 18.

The orientation and position of each leg can be adjusted by both the adjustable clamping assembly 14 and the adjustable support arm 16. The surgeon can selectively adjust lithotomy by raising or lowering the support rod 54 of the adjustable support arm 16 about the lithotomy axis 53 to a desired position. The surgeon squeezes the handle assembly 148 to unlock the locking cylinder 34 and repositions the support rod 54 to a desired position. Because the abduction axis 55 is at an angle relative to vertical, the patient automatically abducts as lithotomy is adjusted to reduce the risk of injury to the patient.

It is noted that the extension force, when provided, assists the surgeon to lift the support rod 54 and must be overcome to lower the support rod 54. It is also noted that the dampening effect provided by the valve assembly 94 of the locking cylinder 34 controls the rate at which the support arm can be raised or lowered so that there are not any rapid and/or undesired changes. Once the support rod 54 is repositioned to the desired position, the surgeon releases the handle assembly 148 and the locking cylinder 34 locks the support rod 54 in the desired position.

Figure 11:
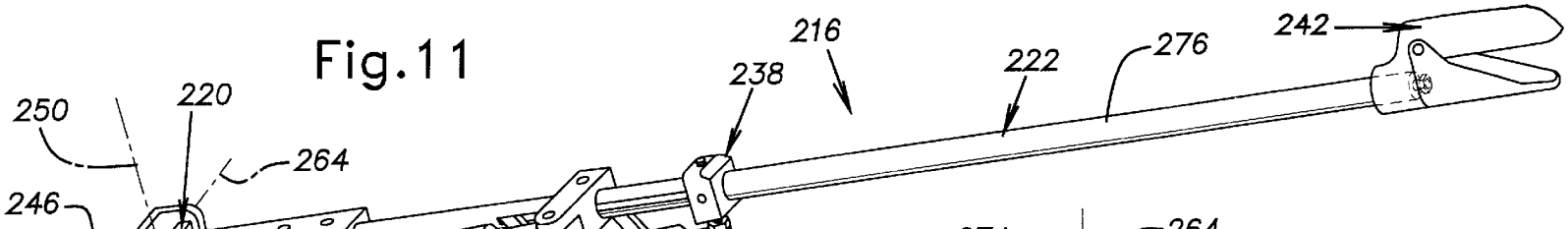
FIG. 11 is a perspective view of a second embodiment of the adjustable support arm of the surgical boot assembly of FIG. 1 with a protective cover removed for clarity.

FIG. 11 illustrates a second embodiment of the adjustable support arm 216 according to the present invention. The second embodiment is substantially the same as the first embodiment, described in detail hereinabove, except that it is adjustable about two axes (lithotomy and abduction/adduction) rather than just one (lithotomy). Preferably, a lower limit of abduction is controlled by a mechanical stop as described in more detail hereinafter.

Figure 12:
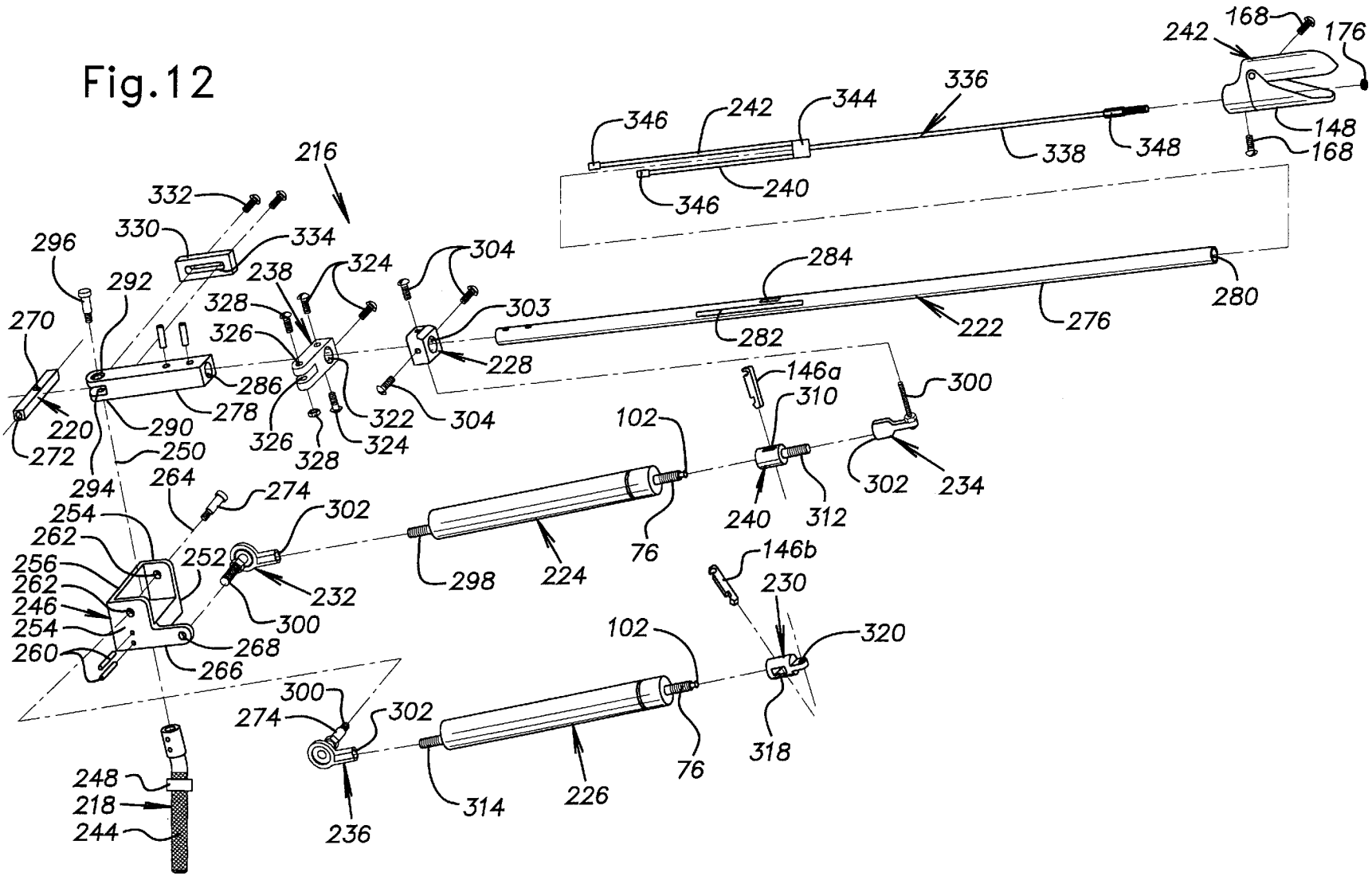
FIG. 12 is an exploded perspective view of the adjustable support arm of FIG. 11.

As best shown in FIGS. 11 and 12, the adjustable support arm 216 includes an attachment 218, a lithotomy axle 220, a rod or arm assembly 222, lithotomy and abduction locking cylinders 224, 226, a lithotomy pivot element 228, an actuator or cylinder head 230, ball joints or spherical rod ends 232, 234, 236, an abduction pivot element 238, an actuator adapter 240, and a remote actuator assembly 242. Preferably, the adjustable support 216 arm also includes a protective cover, which is removed for clarity, similar to the one described hereinabove with regard to the first embodiment.

The attachment 218 includes a post 244 and a base 246. The post 244 is adapted to be removably received and rotationally held within a socket clamp (not shown) of the type typically located at the side of a surgical or operating room table. It is noted that other types of attachments such as, for example, clamps can be utilized to connect the support arm assembly 216 to the operating room table.

The post 244 preferably has a lower end which is knurled to improve interaction with the socket clamp. The post 244 is preferably provided with a ring-shaped stop collar 248 located at a predetermined distance from the lower end of the post 244. The stop collar 248 is sized so that it cannot enter the socket clamp in order to ensure that the post is only inserted into the socket clamp a proper distance.

The post 244 preferably has a bend between the stop collar 248 and the upper end so that an abduction axis 250 formed by the upper end of the post 244 is at an angle relative to vertical when the post 244 is in the vertically extending socket clamp. The bend is preferably sized so that the abduction axis 250 is at an angle in the range of about 10 to about 30 degrees relative to vertical, and more preferably an angle of about 20 degrees relative to vertical. It is noted that the post 244 can be bent to other suitable angles. The post 244 is bent laterally so that the adjustable support arm angles upwardly and outwardly from the side of the operating room table (best shown in FIG. 1).

Figure 13:
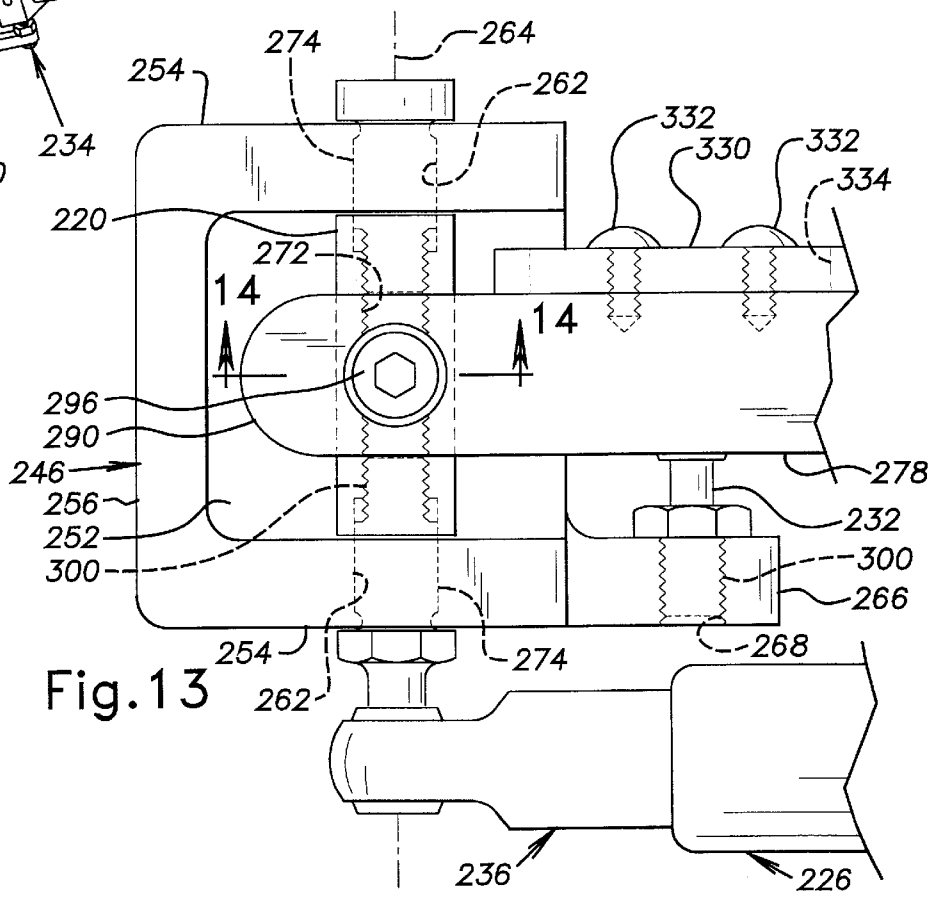
FIG. 13 is an enlarged, fragmented plan view showing the lower end of the adjustable support arm of FIG. 11.
Figure 14:
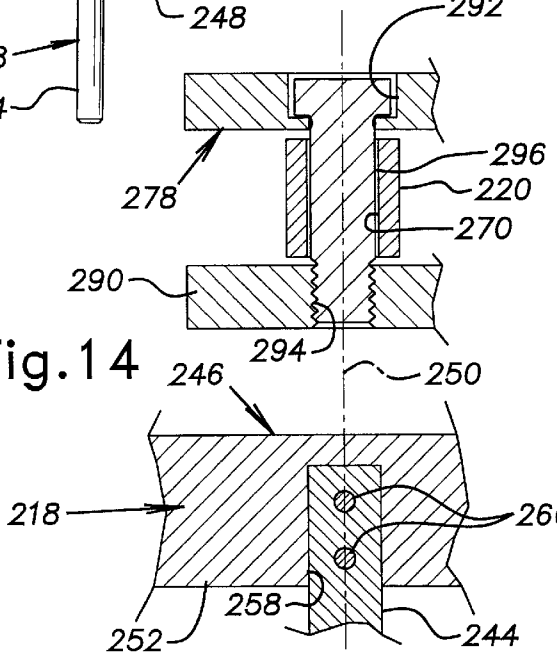
FIG. 14 is a elevational view, in cross-section, taken along line 14—14 of FIG. 13.

As best shown in FIGS. 12, 13, and 14, the base 246 has a bottom wall 252 with integral side and rear walls 254, 256 upwardly extending therefrom. The bottom wall 252 is provided with a blind bore 258 sized for closely receiving the upper end of the post 244 therein. The base 246 is rigidly secured to the post 244 to prevent relative longitudinal or rotational movement therebetween. In the illustrated embodiment, a pair of pins 260 are press fit through the base 246 and the post 244, but alternatively, other types of suitable fasteners can be used. The side walls 254 are provided with coaxial openings 262 and are laterally spaced apart for receiving the lithotomy axle 220 therebetween as described in more detail hereinafter. The openings 262 form the lithotomy axis 264 which is substantially perpendicular to the abduction axis 250.

The base 246 also includes a lug 266 forwardly extending from one side of the bottom wall 252. The lug 266 is provided with a laterally extending threaded hole 268. It is noted that the lug 266 is located on the lateral side of the base 246 where the abduction locking cylinder 226 is to be attached. Therefore, left and right adjustable support tubes 216 will have the lug 266 located on opposite sides.

The lithotomy axle 220 is sized to laterally extend between the side walls 254 of the base 246. The lithotomy axle 220 is provided with a laterally extending central bore 270 and a longitudinally extending threaded hole 272. The ends of the threaded hole 272 are preferably provided with a counter bore.

Shoulder bolts 274 rotationally attach the lithotomy axle 220 to the base 246. The shoulder bolts 274 have shoulder portions closely received in the side wall openings 262 and threaded portions extending into the axle threaded hole 272. Alternatively, threaded portions could extend into threaded holes in the base side walls 254 while shoulder portions are closely received into a bore of the lithotomy axle 220. It is noted that other types of axle members can be utilized such as, for example, a press-fit pin or a rivet. Preferably, one of the shoulder bolts 274 is integral with a spherical rod end 236 attached to the lithotomy locking cylinder 224. Attached in this manner, the lithotomy axle 20 is rotatable about the lithotomy axis 264 which is substantially perpendicular to the abduction axis 250.

The rod assembly 222 includes a support rod 276 and an adapter 278. The support rod 276 is generally elongate and circular in cross-section. A central passage 280 extends through a portion of the support rod 276 from a first or outer end of the support rod 276 to a horizontally-extending slot or opening 282 located at a central portion of the support rod 276. The slot 282 extends through the support rod 276 for a limited longitudinal length of the support rod 276. Additionally, a vertically extending slot or opening 284 is provided along the central passage 280 at a central portion of the support rod 276 along the horizontal slot 282.

The adapter 278 has a first or outer end which forms a socket 286 sized for receiving the second or inner end of the support rod 276. The adapter 278 is rigidly secured to the support rod 276 to prevent relative longitudinal or rotational movement therebetween. In the illustrated embodiment, a pair of pins 288 are press-fit through the support rod 276 and the socket 286 of the adapter 278. The adapter 278 has a second or inner end adapted to be pivotally attached to the lithotomy axle 220. The second end of the adapter 278 forms a clevis 290 sized for receiving the lithotomy axle 220 therein and allowing relative rotation therebetween about the abduction axis 250. The clevis 290 is preferably provided with counterbored opening 292 on one side and a threaded opening 294 on the another side.

As best shown in FIG. 14, a shoulder bolt 296 pivotally attaches the adapter 278 to the lithotomy axle 220. The shoulder bolt 296 has a head portion received within the counterbore 292 of the one side of the clevis 290, a shoulder portion closely received in the central bore 270 of the lithotomy axle 220, and a threaded portion received in the threaded opening 294 of the other side of the clevis 290. It is noted that other types of axle members can be utilized such as, for example, a press-fit pin or a rivet.

As best shown in FIGS. 11 and 12, the lithotomy locking cylinder 224 extends between the attachment 218 and the arm assembly 222 to control rotation of the arm assembly 222 about the lithotomy axis 264 as described in more detail hereinafter. The lithotomy locking cylinder 224 can be any of the types discussed hereinabove in detail with reference to the first embodiment of the adjustable support arm 16 such as, for example, a fluid-type locking cylinder (FIGS. 5, 6*a*, 6*b*) or a mechanical-type locking cylinder (FIG. 6*c*) and can provide either an extension bias or lifting force (FIGS. 5, 6*b*, 6*c*) or no extension bias or lifting force (FIG. 6*b*).

Preferably, the lithotomy locking cylinder 224 is a fluid-type locking cylinder, is infinitely positionable over a range to a desired position, is rigidly blockable or lockable in a desired position by means of a fluid-valve lock, provides an extension or lifting force by means of a gas spring, and dampens movement in both retraction and extension directions. Therefore, the lithotomy locking cylinder 224 is preferably substantially the same as the locking cylinder 34 (FIG. 3) described hereinabove in detail with regard to the first embodiment of the adjustable support arm 16, except that the rear end of the lithotomy locking cylinder 224 is provided with a threaded rod 298 instead of the trunion 82 (FIG. 3).

The rear end of the lithotomy locking cylinder 224 is pivotally attached to the base 218 of the attachment 218 with a spherical rod end 232. The spherical rod end 232 has a first portion with a threaded rod 300 and a second portion with a threaded hole 302 generally perpendicular to the threaded rod 300. The threaded rod 300 is sized to cooperate with the threaded hole 268 of the base lug 266 and threaded hole 302 is sized to receive the threaded rod 298 of the lithotomy locking cylinder 224. Suitable spherical rod ends can be obtained from McMaster-Carr Supply Company.

The forward end of the lithotomy locking cylinder 224 is pivotally attached to arm assembly 222 by the lithotomy pivot element 228, a spherical rod end 234, and the actuator adaptor 240. The lithotomy pivot element 228 has an opening 303 sized for receiving the support rod 276 therein. The lithotomy pivot element 228 is secured to the central portion of the support rod 276 in a position slightly forward of the vertical slot 284. The lithotomy pivot element 228 of the illustrated embodiment is rigidly secured to the support rod 276 with three set screws 304. The lithotomy pivot element 228 also has a threaded opening 306 (FIG. 15) positioned below the support rod 276. The threaded opening 306 of the lithotomy pivot element 228 is sized to cooperate with the threaded rod 300 of the spherical rod end 234.

Figures 15, 16:
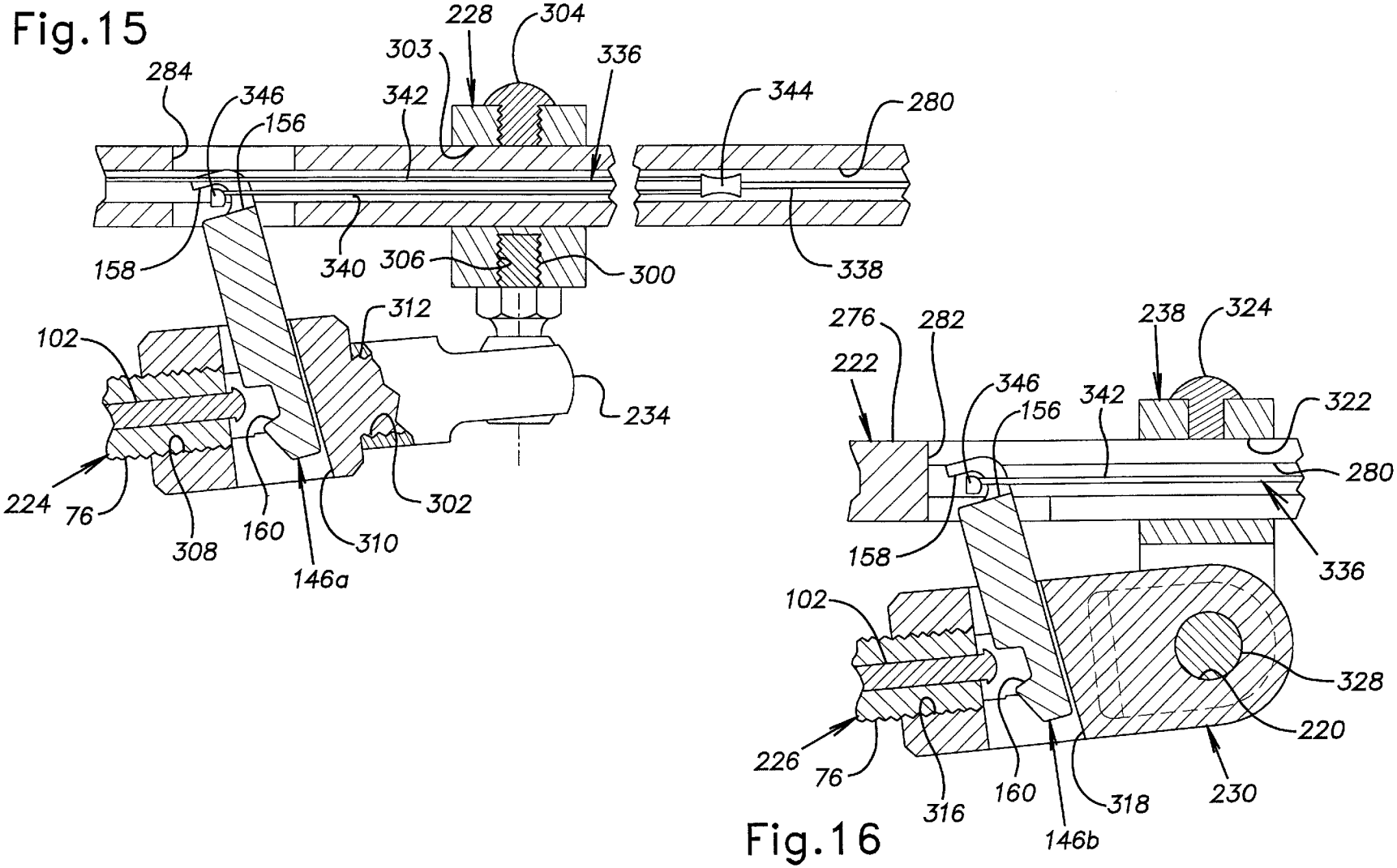
FIG. 15 is an enlarged, fragmented elevational view, partially in cross-section, of a portion of the remote actuator assembly of the adjustable support arm of FIG. 11.
FIG. 16 is an enlarged, fragmented plan view, in cross-section, of another portion of the remote actuator assembly of the adjustable support arm of FIG. 11.

As best shown in FIGS. 12 and 15, the actuator adapter 240 has a threaded opening sized 308 for cooperating with the piston rod 76 of the lithotomy locking cylinder 224 to secure the actuator adapter 240 to the end of the piston rod 76. The threaded opening 308 extends from a rear end of the actuator adapter 240 to a slot 310. The slot 310 is substantially the same as the slot 126 (FIG. 10) of the actuator head 40 described in detail hereinabove. The actuator adapter 240 also has a threaded rod 312 substantially coaxial with the threaded opening 308. The threaded rod 312 is sized to cooperate with the threaded hole 302 of the spherical rod end 234.

Secured in this manner, the lithotomy locking cylinder 224 supports the arm assembly 222 against rotation about the lithotomy axis 264 when the lithotomy locking cylinder 224 is locked. While the illustrated lithotomy locking cylinder 224 is configured to support downward loads in compression, it is noted that the lithotomy locking cylinder 224 can alternatively be configured and secured in manner to support them in tension. With the lithotomy locking cylinder 224 pivotally connected at each end between the attachment 218 and the arm assembly 222, the arm assembly 222 can be infinitely raised and lowered about the lithotomy axis 264 between upper and lower limits when the lithotomy locking cylinder 224 is unlocked. Preferably, lithotomy can be adjusted over the range of about −22 degrees to about +90 degrees relative to horizontal.

As best shown in FIGS. 11 and 12, the abduction locking cylinder 226 extends between the lithotomy axle 220 and the arm assembly 222 to control rotation of the arm assembly 222 about the abduction axis 250 as described in more detail hereinafter. The abduction locking cylinder 226 can be any of the types discussed hereinabove in detail with reference to the first embodiment of the adjustable support arm 16 such as, for example, a fluid-type locking cylinder (FIGS. 5, 6*a*, 6*b*) or a mechanical-type locking cylinder (FIG. 6*c*) and can provide either an extension bias or lifting force (FIGS. 5, 6*b*, 6*c*) or no extension bias or lifting force (FIG. 6*b*).

Preferably, the abduction locking cylinder 226 is a fluid-type locking cylinder, is infinitely positionable over a range to a desired position, is rigidly blockable or lockable in a desired position by means of a fluid-valve lock, provides an extension or lifting force by means of a gas spring, and dampens movement in both retraction and extension directions. Therefore, the abduction locking cylinder 226 is preferably substantially the same as the locking cylinder 34 (FIG. 3) described hereinabove with regard to the first embodiment of the adjustable support arm 16, except that the rear end of the cylinder is provided with a threaded rod 314 instead of the trunion 82 (FIG. 3).

The rear end of the abduction locking cylinder 226 is pivotally attached to the lithotomy axle 220 with a spherical rod end 236. As noted above, one of the shoulder bolts 274 is preferably integral with the spherical rod end 236. The forward end of the abduction locking cylinder 226 is pivotally attached to the arm assembly 222 by the actuator head 230 and the abduction pivot element 238.

As best shown in FIGS. 12 and 16, the actuator head 230 has a threaded opening 316 sized for cooperating with the piston rod 76 of the abduction locking cylinder 226 to secure the actuator head 230 to the end of the piston rod 76. The threaded opening 316 extends from a rear end of the actuator head 230 to a slot 318. The slot 318 is substantially the same as the slot 126 (FIG. 10) of the actuator head 40 described in detail hereinabove. The actuator head 230 also has a trunnion with a laterally extending opening 320. The trunnion is sized to cooperate with the abduction pivot element 238.

The abduction pivot element 238 has an opening 322 sized for receiving the support rod 276 therein. The abduction pivot element 238 is secured to the central portion of the support rod 276 in a position along the horizontal slot 282 and slightly behind the vertical slot 284. The abduction pivot element 238 of the illustrated embodiment is secured to the support rod 276 with three set screws 324. The abduction pivot element 238 also has a clevis with laterally extending openings 326. The clevis is sized to cooperate with the trunnion of the actuator head 230. It is noted that when the lithotomy and abduction cylinders 224, 226 have the same effective length, such as when they are both mechanical-type locking cylinders, the abduction pivot element 238 can be combined with the lithotomy pivot element 228.

As best shown in FIGS. 12 and 16, a bolt and nut combination 328 pivotally attach the trunnion of the actuator head 230 and the clevis of the abduction pivot element 238. It is noted that other types of axle members can be utilized such as, for example, a press-fit pin or a rivet.

Secured in this manner, the abduction locking cylinder 226 supports the arm assembly 276 against rotation about the abduction axis 250 when the abduction locking cylinder 226 is locked. With the abduction locking cylinder 226 pivotally connected at each end between the lithotomy axle 220 and the arm assembly 222, the arm assembly 222 can be infinitely pivoted in and out about the abduction axis 250 between inner and outer limits when the abduction locking cylinder 226 is unlocked. Preferably, abduction can be adjusted over the range of about 10 degrees to about 45 degrees relative to vertical.

While the abduction locking cylinder 226 can be provided with or without an extension force, the abduction locking cylinder 226 preferably includes an extension force which biases the arm assembly 222 to the smallest abduction or lower limit. This bias to the smallest abduction provides the adjustable support arm 216 with the auto-abduction characteristic present in the first embodiment of the adjustable support arm 16. This bias, however, can be easily overcome when it is desired to adjust abduction.

As best shown in FIGS. 12 and 13, the smallest abduction or lower limit is preferably controlled by an adjustable mechanical stop. The illustrated mechanical stop includes a plate 330 secured to the side of the arm assembly adapter 278. The plate 330 is positioned to contact the side wall 254 of the base 246 when the arm assembly 22. It can be appreciated, therefore, that the abduction lower limit can be adjusted by changing the thickness of the plate 330. The plate 330 of the illustrated embodiment is removably secured with threaded fasteners 332 but other suitable means for removably securing the plate 330 can be alternatively utilized. The plate 330 also is also preferably provided with a slot 334 so that it can be slid between a position where it controls the abduction lower limit and a position where it does not control the abduction lower limit. It can be appreciated, therefore, that a plurality of plates 330 can be used so that varying numbers of plates 330 can be moved to the controlling position to adjust the abduction lower limit.

As best shown in FIGS. 12, 15 and 16, the remote actuator assembly 242 includes a cable assembly 336, a lithotomy and abduction actuator levers 146*a*, 146*b*, and a handle assembly 148. The actuator assembly 242 unlocks the lithotomy and abduction locking cylinders 224, 226 so that the arm assembly 222 can be moved to a desired position. Preferably, the actuator assembly 242 allows the locking cylinders 224, 226 to be unlocked at a location remote from the locking cylinders 224, 226. In the illustrated embodiment, the locking cylinders 224, 226 are unlocked by squeezing the handle assembly 148 at the forward end of the arm assembly 222.

The cable assembly 336 includes a main cable 338, first and second extension cables 340, 342, a connecting element 344, a pair of radius plugs 346, and a threaded terminal 348. The cables 338, 340, 342 are preferably wire rope but other suitable cables or flexible rods can be utilized. It is noted that it may be necessary for the extension cables 340, 342 to include push-pull type cables having an outer sheath or conduit and a flexible inner cable or core which is pushed and pulled through the conduit, particularly when the there is not a fixed distance between the release of the locking cylinder and the handle assembly 148.

The forward ends of the first and second extension cables 340, 342 are each connected to the rear end of the main cable 338 by the connecting element 344. Preferably, the cables 338, 340, 342 are swaged together. The first and second extension cables 340, 342 are sized to extend to the lithotomy and abduction actuator levers 146*a*, 146*b* respectively. It is noted that with the mechanical-type locking cylinders 34*c* (FIG. 6*c*), the actuator levers 146*a*, 146*b* can be eliminated with the extension cables 340, 342 extending to the release assembly 114.

The radius plugs 346 are secured to the rear ends of the first and second extension cables 340, 342 and are sized to cooperate with the actuator levers 146*a*, 146*b*. The threaded terminal 348 is secured to the forward end of the main cable 338 and is sized to cooperate with the handle assembly 148 as described in detail hereinabove with regard to the first embodiment of the support arm 16. The actuator levers 146*a*, 146*b* and the handle assembly 148 are substantially the same as described herein above with regard to the first embodiment of the adjustable support arm 16.

When the handle assembly 148 is squeezed, the cable assembly 336 including both the first and second extension cables 340, 342 is pulled in a forward direction. The first extension cable 340 forwardly pulls the upper end of the lithotomy actuator lever 146*a* to unlock the lithotomy locking cylinder 224 and the second extension cable 342 forwardly pulls the upper end of the abduction actuator lever 146*b* to unlock the abduction locking cylinder 226. When the handle assembly 148 is released, the handle bias returns the handle assembly 148 to the unactuated position and the bias of the locking cylinders 224, 226 returns the locking cylinders 224, 226 to the locked or unactuated position. It is noted that other types of remote actuator assemblies 242 can be utilized such as, for example, a rotating handle with a cam such as disclosed in U.S. Pat. No. 5,560,577 which is expressly incorporated herein in its entirety by reference. The "squeezing-action" of the present invention, however, is preferable over other types of manipulations such as, for example, twisting or turning.

It can be seen from the above description of the remote actuation assembly 242 that both the lithotomy and abduction locking cylinders 224, 226 are unlocked by squeezing the same handle assembly 148. When the lithotomy and abduction locking cylinders 224, 226 require the same actuation distance for unlocking, they are unlocked simultaneously. By providing the abduction locking cylinder 226 with a greater actuation distance, however, the lithotomy locking cylinder 224 is unlocked prior to the abduction locking cylinder 226. Therefore, the operator can unlock the lithotomy locking cylinder 224, but not the abduction locking cylinder 226, by partially squeezing the handle assembly 148 and unlock both the lithotomy and abduction cylinders 224, 226 by fully squeezing the handle assembly 148.

During use, the adjustable support arm 216 can be adjusted in both lithotomy and abduction. The surgeon can selectively adjust lithotomy by raising or lowering the arm assembly 222 of the adjustable support arm 216 about the lithotomy axis 264 to a desired position. The surgeon squeezes the handle assembly 148 to unlock the locking cylinders 224, 226 and repositions the arm assembly 222 to a desired position. When provided, the extension force of the lithotomy locking cylinder 224 assists the surgeon to lift the arm assembly 222 and must be overcome to lower the arm assembly 222.

The extension force of the abduction locking cylinder 226, when provided, ensures that the patient is automatically abducted when lithotomy is adjusted to reduce the risk of injury to the patient. When it is desired to adjust abduction, however, the surgeon can overcome the extension force of the abduction cylinder to pivot the arm assembly about the abduction axis 250. Once the arm assembly 222 is in the desired position, the surgeon releases the handle assembly 148 and the locking cylinders 224, 226 lock the arm assembly 222 in the desired position.

Although particular embodiments of the invention have been described in detail, it will be understood that the invention is not limited correspondingly in scope, but includes all changes and modifications coming within the spirit and terms of the claims appended hereto.

What is claimed is:

1. An adjustable support arm for supporting a limb, said adjustable support arm comprising:

an attachment;

an axle secured to said attachment and rotatable relative to said attachment about a first axis;

a support arm having an end pivotally attached to said axle and pivotable about a second axis, said second axis being substantially perpendicular to said first axis;

a first extendable and retractable locking cylinder having a first end pivotally attached to said attachment and a second end pivotally attached to said support arm, wherein said first locking cylinder is unlockable to pivot said support arm about said first axis to a desired position and lockable to retain said support arm in the desired position; and a second extendable and retractable locking cylinder having a first end pivotally attached to said axle and a second end pivotally attached to said support arm, wherein said second locking cylinder is unlockable to pivot said support arm about said second axis to a desired position and lockable to retain said support arm in the desired position.

2. The adjustable support arm according to claim 1, wherein at least one of said first and second locking cylinders is a fluid-type cylinder.

3. The adjustable support arm according to claim 2, wherein said fluid-type cylinder includes a piston with an integral valve.

4. The adjustable support arm according to claim 2, wherein said fluid-type cylinder includes a separating piston forming a gas spring to provide an extension force.

5. The adjustable support arm according to claim 2, wherein said fluid-type cylinder includes a mechanical spring to provide an extension force.

6. The adjustable support arm according to claim 1, wherein at least one of said first and second locking cylinders is a mechanical-type cylinder.

7. The adjustable support arm according to claim 6, wherein s aid mechanical-type cylinder includes a mechanical spring to provide an extension force.

8. The adjustable support arm according to claim 1, wherein at least one of said first and second locking cylinders includes means for biasing said locking cylinder to an extended length.

9. The adjustable support arm according to claim 8, wherein said biasing means includes a gas spring.

10. The adjustable support arm according to claim 8, wherein said biasing means includes a mechanical spring.

11. The adjustable support arm according to claim 1, wherein said second locking cylinder includes means for biasing said second locking cylinder to an extended length.

12. The adjustable support arm according to claim 1, wherein each of said first and second locking cylinders include means for biasing said first and second locking cylinders to an extended length.

13. The adjustable support arm according to claim 1, further comprising an actuator assembly located remote from said first and second locking cylinders and connected to each of said first and second locking cylinder to selectively lock and unlock both of said first and second locking cylinders.

14. The adjustable support arm according to claim 13, wherein said actuator assembly is located at a second end of said support arm.

15. The adjustable support arm according to claim 13, wherein said actuator assembly simultaneously unlocks said first and second locking cylinders.

16. The adjustable support arm according to claim 13, wherein said actuator assembly unlocks said first locking cylinder prior to unlocking said second locking cylinder.

17. A stirrup for an operating room table, said stirrup comprising:

a limb support;

an adjustable support arm including:

an attachment;

an axle secured to said attachment and rotatable relative to said attachment about a first axis;

a support rod having an end pivotally attached to said axle and pivotable about a second axis, said second axis being substantially perpendicular to said first axis;

a first extendable and retractable locking cylinder having a first end pivotally attached to said attachment and a second end pivotally attached to said support rod, wherein said first locking cylinder is unlockable to pivot said support rod about said first axis to a desired position and lockable to retain said support rod in the desired position; and a second extendable and retractable locking cylinder having a first end pivotally attached to said axle and a second end pivotally attached to said support rod, wherein said second locking cylinder is unlockable to pivot said support rod about said second axis to a desired position and lockable to retain said support rod in the desired position; and an adjustable clamping assembly attaching said limb support to said support rod of said adjustable support arm.

18. The adjustable support arm according to claim 17, wherein at least one of said first and second locking cylinders is a fluid-type cylinder.

19. The adjustable support arm according to claim 18, wherein said fluid-type cylinder includes a separating piston forming a gas spring to provide an extension force.

20. The adjustable support arm according to claim 17, wherein at least one of said first and second locking cylinders is a mechanical-type cylinder.

21. The adjustable support arm according to claim 20, wherein said mechanical-type cylinder includes a mechanical spring to provide an extension force.

22. The adjustable support arm according to claim 17, wherein at least one of said first and second locking cylinders includes means for biasing said locking cylinder to an extended length.

23. The adjustable support arm according to claim 17, wherein said second locking cylinder includes means for biasing said second locking cylinder to an extended length.

24. The adjustable support arm according to claim 17, wherein each of said first and second locking cylinders include means for biasing said first and second locking cylinders to an extended length.

25. The adjustable support arm according to claim 17, further comprising an actuator assembly located remote from said first and second locking cylinders and connected to each of said first and second locking cylinder to selectively lock and unlock both of said first and second locking cylinders.

26. An adjustable support arm for supporting a limb of a person during surgery, said adjustable support arm comprising:

an attachment;

an axle secured to said attachment and rotatable relative to said attachment about a lithotomy axis;

a support arm having an end pivotally attached to said axle and pivotable about an abduction axis, said abduction axis being substantially perpendicular to said lithotomy axis;

a lithotomy locking cylinder having a first end pivotally attached to said attachment and a second end pivotally attached to said support arm, said lithotomy locking cylinder including a cylinder and a piston within said cylinder and having an integral valve, said piston dividing said cylinder into first and second, said first and second portions being selectively in fluid communication through said integral valve and each containing a fluid to provide locking; and an abduction locking cylinder having a first end pivotally attached to said axle and a second end pivotally attached to said support arm, said abduction locking cylinder including a cylinder, a piston within said cylinder and having an integral valve, and a separating piston within said cylinder, said piston and said separating piston dividing said cylinder into first, second, and third portions, said first and second portions being selectively in fluid communication through said integral valve and each containing an incompressible fluid to provide rigid locking, said third portion containing a compressed gas to bias the support arm to a minimum abduction position.

27. An adjustable support arm for supporting a limb of a person during surgery, said adjustable support arm comprising:

an attachment;

an axle secured to said attachment and rotatable relative to said attachment about a lithotomy axis;

a support arm having an end pivotally attached to said axle and pivotable about an abduction axis, said abduction axis being substantially perpendicular to said lithotomy axis;

a lithotomy locking cylinder having a first end pivotally attached to said attachment and a second end pivotally attached to said support arm, said lithotomy locking cylinder including a cylinder, a piston within said cylinder and having an integral valve, and a separating piston within said cylinder, said piston and said separating piston dividing said cylinder into first, second, and third portions, said first and second portions being selectively in fluid communication through said integral valve and each containing an incompressible fluid to provide rigid locking, said third portion containing a compressed gas to provide the support arm with an assisting lift force; and an abduction locking cylinder having a first end pivotally attached to said axle and a second end pivotally attached to said support arm, said abduction locking cylinder including a cylinder, a piston within said cylinder and having an integral valve, and a separating piston within said cylinder, said piston and said separating piston dividing said cylinder into first, second, and third portions, said first and second portions being selectively in fluid communication through said integral valve and each containing an incompressible fluid to provide rigid locking, said third portion containing a compressed gas to bias the support arm to a minimum abduction position.

* * * * *